US006173877B1

(12) United States Patent
Wingert

(10) Patent No.: US 6,173,877 B1
(45) Date of Patent: Jan. 16, 2001

(54) NAIL MAGAZINE FOR A POWER NAILER

(75) Inventor: Rudolf Wingert, West Milford, NJ (US)

(73) Assignee: Arrow Fastener Co., Inc., Saddle Brook, NJ (US)

( * ) Notice: Under 35 U.S.C. 154(b), the term of this patent shall be extended for 0 days.

(21) Appl. No.: 09/434,405

(22) Filed: Nov. 5, 1999

(51) Int. Cl.[7] ..... B25C 1/04
(52) U.S. Cl. ..... 227/109; 227/120; 227/136
(58) Field of Search ..... 227/109, 120, 227/119, 136

(56) References Cited

U.S. PATENT DOCUMENTS 3,797,723 * 3/1974 Perkins et al. ..... 227/109
4,304,349 * 12/1981 Novak et al. ..... 227/109
4,375,867 * 3/1983 Novak et al. ..... 227/109
4,524,896 * 6/1985 Morrell, Jr. ..... 227/120
4,749,115 * 6/1988 Fehrs ..... 227/109
5,180,091 * 1/1993 Ota ..... 227/120
5,588,577 * 12/1996 Chen ..... 227/120

* cited by examiner

*Primary Examiner*—Scott A. Smith
(74) *Attorney, Agent, or Firm*—Fitzpatrick, Cella, Harper & Scinto

(57) ABSTRACT

A nail magazine for a power nailer is disclosed which includes an elongated housing formed from a pair of parallel side walls which have a plurality of opposed elongated channels formed therein cooperating to define a plurality of guide tracks which receive the heads of a strip of nails fitting between the side walls. The side walls have a discharge end from which nails in the strip are discharged. The nails are biased towards the discharge end of the strip by a spring pusher arrangement including a flat plate received between the side walls.

11 Claims, 5 Drawing Sheets

NAIL MAGAZINE FOR A POWER NAILER

BACKGROUND OF THE INVENTION

Field of the Invention

The present invention relates to nail magazines for power nailers and more particularly to a magazine adapted to accommodate a plurality of different length nails.

Power nailers, both of the electric and pneumatic type, have been known for many years. These nailers typically include a magazine that is adapted to hold a strip of nails which can be driven one at a time as the strip is advanced through a drive head and engaged by a reciprocating knife or hammer. Typically these magazines are adapted to hold a single size nail, therefore their flexibility is limited. While some power nailers have been provided with nail magazines that can hold different size nails, these have been generally quite bulky and expensive to manufacture. They are also sometimes difficult to use.

It is an object of the present invention to provide a nail magazine for a power nailer which can accommodate several different size nails.

Another object of the present invention is to provide a nail magazine for a power nailer which is relatively simple in construction.

A further object of the present invention is to provide a nail magazine for a power nailer which is relatively inexpensive in construction yet provides smooth and jam-free operation.

BRIEF SUMMARY OF THE INVENTION

A nail magazine in accordance with the present invention is adapted for use on a power nailer having a reciprocating nail driving element that is adapted to drive a nail positioned in the driving elements path of travel. That driving element may be a hammer or knife reciprocated electrically by a solenoid or electric drive motor, or pneumatically such as would be understood by those skilled in the art.

The magazine is formed from an elongated housing including a pair of parallel side walls which define a narrow longitudinal slot therebetween for receiving a strip of nails. The nails are of a conventional construction, e.g. ½ inch to 1 inch finish nails and may be adhered together by an appropriate adhesive or lacquer as is common in the art.

The housing's longitudinal slot has an open lower end through which the nails project. The side walls have a plurality longitudinally extending opposed channels formed therein, with the channels on one side wall opening towards an opposing channel on the other side wall to selectively receive therebetween the heads of the nails in different size strips.

The housing side walls have a nail discharge end and a nail guide is mounted on that discharge end. The guide includes a nail guide channel formed therein opening towards the slot between the side walls to receive an individual nail. A spring biasing arrangement is provided for urging a strip of nails positioned in the slot between the side walls towards the discharge end so that a nail is automatically positioned in the nail guide channel where it can be engaged by the driving element or knife.

The above, and other objects, features and advantages of the present invention will be apparent from the following detailed description of an illustrative embodiment thereof, which is to be read in connection with the accompanying drawings wherein:

DETAILED DESCRIPTION

Figure 1:
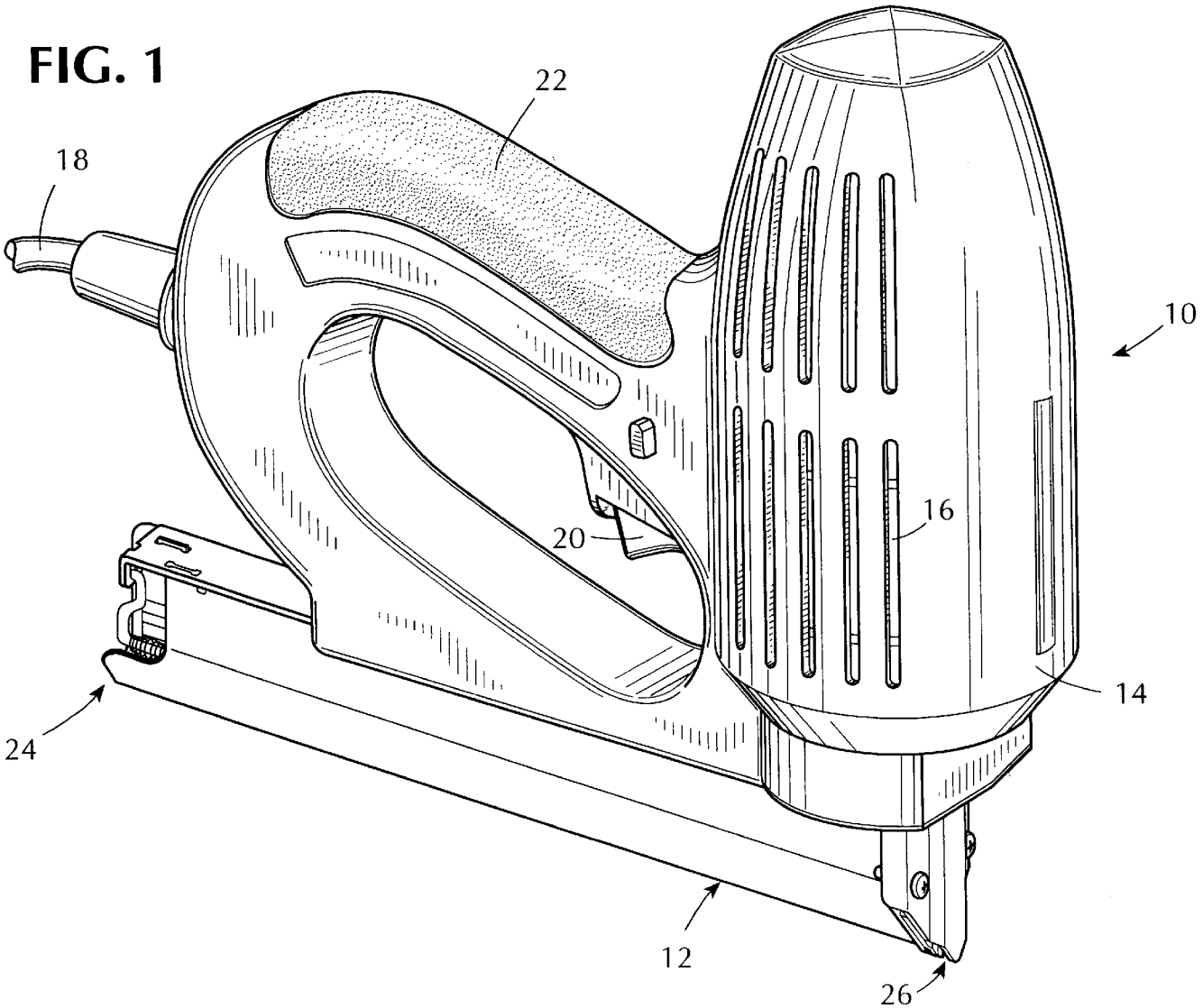
FIG. 1 is a perspective view of a power nailer including a nail magazine constructed in accordance with the present invention.
Figure 2:
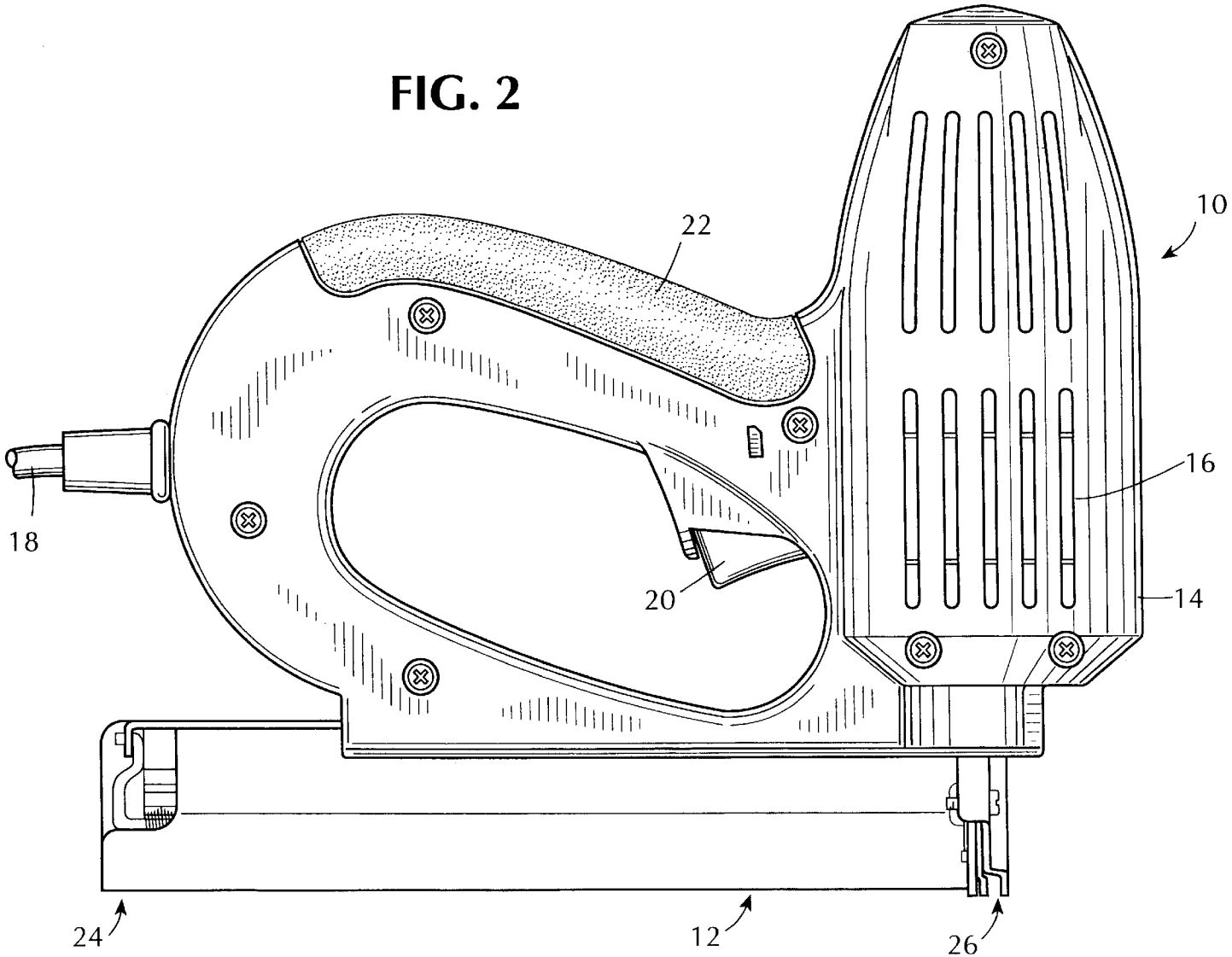
FIG. 2 is a side elevation of the device illustrated in FIG. 1.
Figure 3:
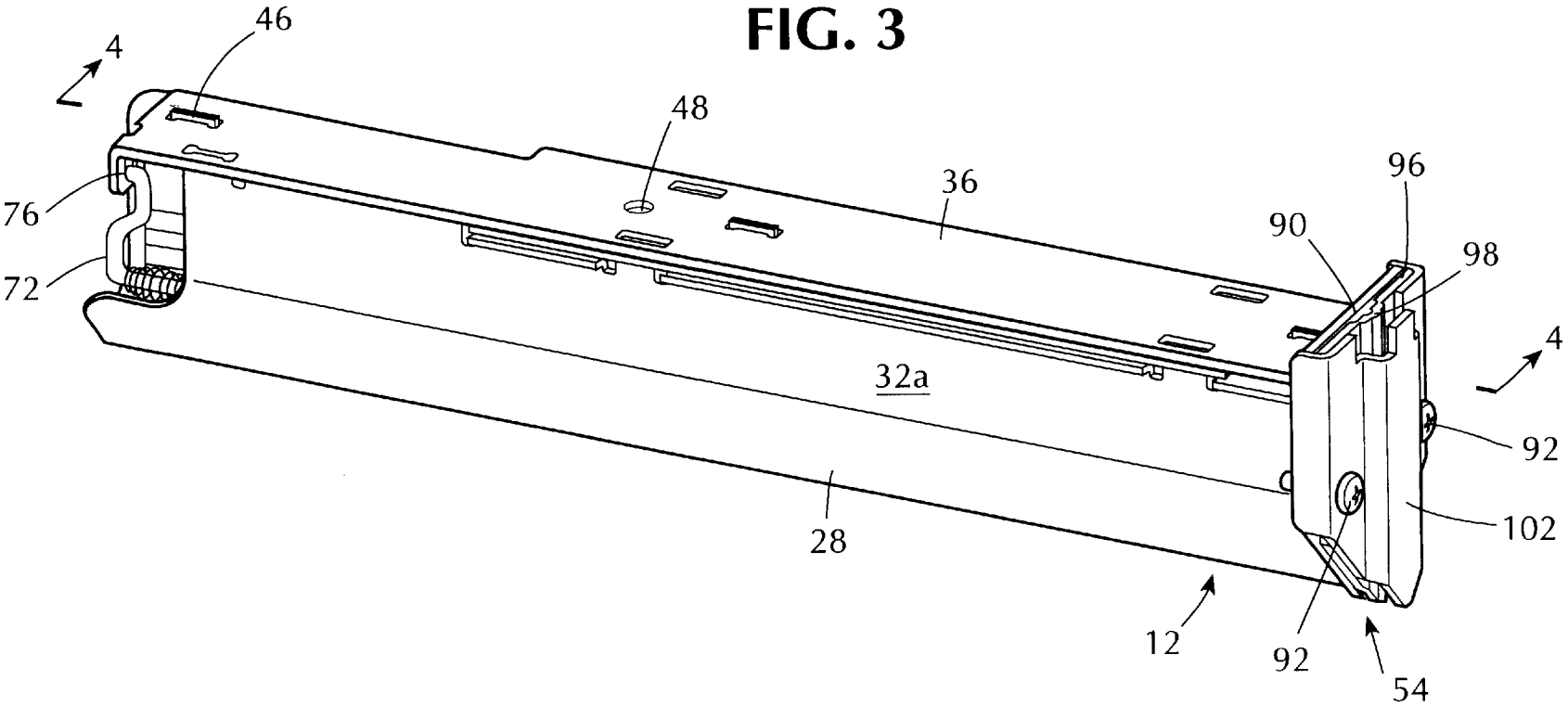
FIG. 3 is an enlarged perspective view of the magazine of the present invention.

Referring now to the drawings, and initially to FIG. 1, an electric nailer 10, including a nail magazine 12 constructed in accordance with the present invention, is illustrated. Nailer 10 has a housing 14 which contains an electric power head 16 within it constructed in a generally conventional manner. Power is supplied to head 16 from a power supply cord 18. A conventional trigger mechanism 20 is provided in the handle 22 to operate the power head and drive a nail contained in magazine 12. Power head 16 is provided with a solenoid structure or electric drive motor in the known manner to reciprocate a hammer or so called "knife" which engages the top a nail in magazine 12 to drive it into a work piece.

Figure 6:
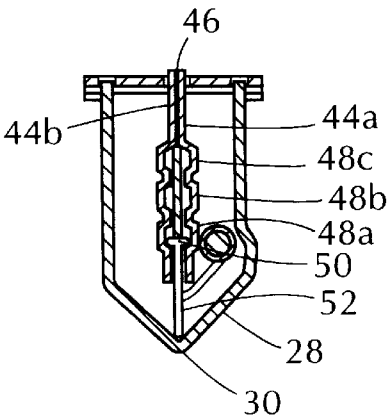
FIGS. 5 and 6 are sectional views taken along lines 5—5 of FIG. 4 showing two different size nails contained in the magazine.
Figure 5:
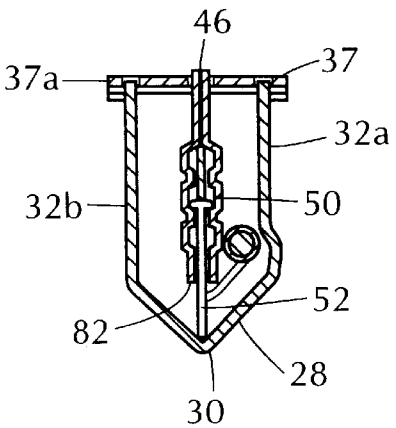

Magazine 12 has a rear nail loading end 24 and a front end 26 located beneath power head 16. As seen in the exploded perspective view of FIG. 7, magazine 12 has an external casing 28 which, as seen in FIGS. 5 and 6 has a generally V-shaped face 30 and parallel side walls 32*a* and 32*b*.

A housing 34 is received within casing 28 and is secured in place by a top plate 36. The top plate is pressed fit onto tabs 40 formed in the top edges 42 of casing 28.

Housing 34 is formed of a pair of parallel side plates 44*a* and 44*b* which have tabs 46 formed on their upper ends which are also pressed fit in complementary slots formed in the cover 36.

Cover 36 is received within the housing 14 of the nail gun and secured thereto in any convenient manner, for example, by having the flanges 37 along the sides of cover 36 received in grooves or the like in the housing.

The longitudinally side walls 44 of housing 34 are formed so that they are slightly spaced from one another as seen in FIGS. 5 and 6. In addition they are provided with a plurality of longitudinally extending channels 48*a*, 48*b* and 48*c* which open towards each other, as seen in FIGS. 5 and 6. These channels cooperate to provide elongated spaces between the side walls to receive the heads 50 of nails 52.

Figure 4:
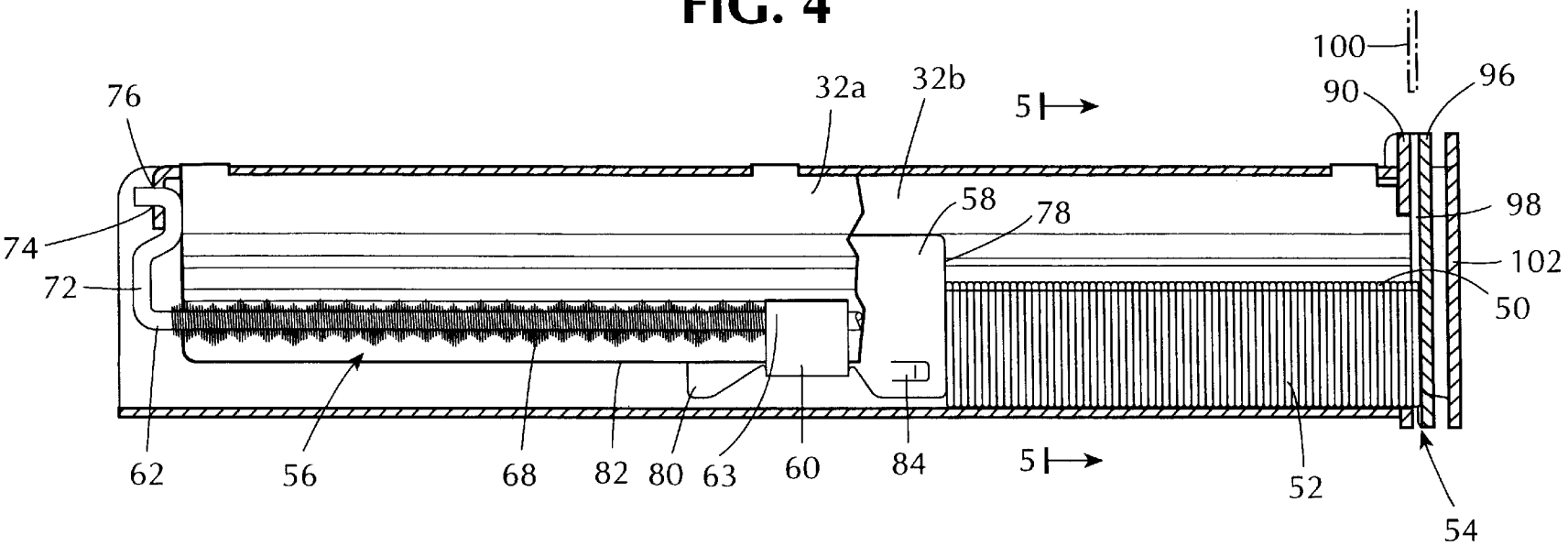
FIG. 4 is a sectional view with parts broken away taken along line 4—4 of FIG. 3.

As seen for example in FIGS. 4 and 5, a strip of nails 52 is received in the slot defined between the side walls 44 with the head 50 in channel 48*b*. These strips of nails are of conventional construction. They are formed with an adhesive or lacquer like coating so the strip maintains its integrity until a nail is driven from the end of the strip. By providing three sets of channels 48, different size nail strips can be received and stored in the magazine housing 34. Thus, as seen in FIG. 6 a strip of nails of shorter length than those shown in FIG. 5 is illustrated with their nail heads 50 captured within the lower channel 48*a*.

The strip of nails 52 is biased towards the discharge end 54 of the housing 34 by a pusher assembly 56. This assembly consists of a flat plate 58 having an extended tab 60 formed on one side thereof. A pusher rod 62 is slidably received within the turned or cylindrical end 63 of tab 64, so that plate 58 can slide along the length of rod 62. The forward end 63 of rod 62 is swedged or staked in the conventional manner to form stops for movement of the plate with washers 64 behind the swedging to prevent snaggings. A coil spring 68 surrounds rod 62 and applies a biasing force against plate 58 to urge the plate towards the forward end of the rod.

Pusher assembly 56 is inserted in housing 34 after a strip of nails is placed in the housing. The nails are introduced through the rear end assembly of the housing into the slot formed between side walls 44. Thereafter pusher plate 56 is introduced into the slot and engaged against the nail strip. Rod 62 then is manually pushed forwardly within the casing 28 until the hook 72 on its end can be engaged in an aperture 74 formed in the rear tab 76 on cover 36. This is a conventional latching arrangement known to those skilled in the art from conventionally available staple gun tackers. The front end 78 of plate 56 thus engages against the rear nail in the nail strip 52 to urge the strip forward in the magazine.

As seen in FIG. 4 the bottom end 80 of the plate 56 extends below the bottom edge 82 of the slot formed between side walls 44 so that its front edge fully engages the rear of the nail strips, regardless of the length of the strips used thereby to prevent tilting and jamming of the nails in the magazine. The tab 60, as seen in FIGS. 5 and 6, projects outwardly below the housing 34 and travels along the exterior of member 44*a*.

To guide the sliding movement of the plate in housing 34, a tab 84 is formed by a press operation in plate 56. This tab will ride along the bottom edge 82 of one of the plates 44 to prevent plate 56 from tilting in the housing. In addition the forward end 86 of the tab will act as a stop when it engages the front wall of the magazine.

Magazine 34 is provided with a front wall 90 which is secured to the front end of the casing 12 by bolts 92 engaged in threaded apertures 93 formed in the tabs 94 formed on casing 12. The front plate 90 has a slot 95 formed therein which allows the nails to pass through the front wall. The front end 86 of tab 84 engages the rear end of the wall 90 when the last nail in the strip is discharged, to prevent the front end of the plate from entering into the path of travel of the reciprocating knife.

Figure 7:
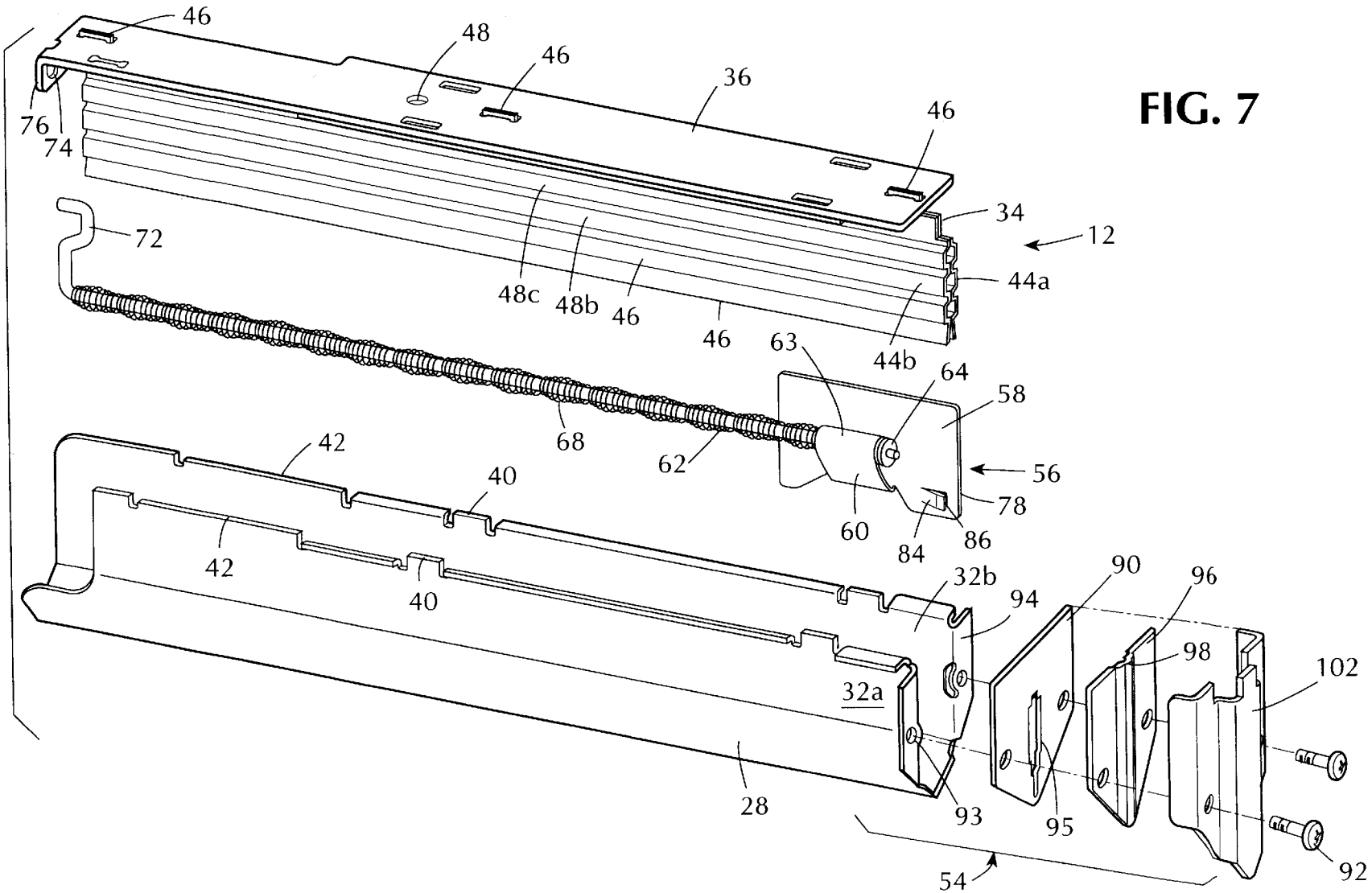
FIG. 7 is an exploded perspective view of the magazine of the present invention.

As seen in FIGS. 4 and 7, the front end of the casing 12 also includes a guide wall 96. This guide wall has a channel 98 formed therein which is in the path of travel of the reciprocating knife 100 of the drive assembly. Knife 100 is shown in dotted lines in FIG. 4. Channel 98 receives the forward most nail of the strip, as seen in FIG. 4, which is biased into that position by the assembly 56. The knife then can reciprocate in the space in between plates 90 and 96 in order to drive the nail into a work piece.

Finally, a cover 102 is provided over the assembly walls 90 and 96, with all three elements being held in place by bolts 92 secured to tabs 94.

By this arrangement a relatively simple nailer magazine for a power nailer is provided which is relatively easy and inexpensive to construct, yet durable and reliable in use.

Although an illustrative embodiment to the present invention has been described herein with reference to the accompanying drawings, it is to be understood that the invention is not limited to this precise embodiment, and that various changes and modifications or the effect therein by those skilled in the art without departing from the scope of spirit of this invention.

What is claimed:

1. A nail magazine for a power nailer having a nail driving element, said magazine comprising an elongated housing including a pair of generally flat parallel side walls; said side walls having a plurality of opposed elongated channels formed therein cooperating to define a plurality of guide tracks for the heads of a strip of nails with flat portions of the side walls above, below and between said channels; said side walls having a discharge end; and means for urging a strip of nails positioned between said side walls towards said discharge end, said urging means including a relatively flat plate received between said side walls and biasing means located outside of said side walls and connected to said plate below the side walls for biasing said plate against a nail strip and towards said discharge end; said side walls having bottom longitudinal edges and said plate extending past said edges; and said plate including means engaging one of said bottom longitudinal edges for guiding the plate in longitudinal movement and preventing upward movement of the plate relative to said edges.

2. A nail magazine as defined in claim 1 including a front wall mounted adjacent the discharge end of said side walls; said front wall having a discharge slot formed therein generally complementary to the lateral spacing of the side walls.

3. A nail magazine as defined in claim 2 wherein said plate includes means for engaging said front wall thereby to limit movement of said plate under the influence of said biasing means.

4. A nail magazine as defined in claim 3 wherein said means engaging one of said bottom longitudinal edges and said means for engaging said front wall comprises a flat finger projecting laterally of the plate below said one of said bottom longitudinal edges.

5. A nail magazine as defined in claim 2 including a nail guide plate secured to said front plate and including a nail guide channel opening towards said slot to receive a nail exiting the slot and the nail driving element of the nailer.

6. A nail magazine for a power nailer having a reciprocating nail driving element to drive a nail positioned in the element's path of travel; said magazine comprising an elongated housing including a pair of parallel side walls defining a narrow longitudinal slot therein for receiving a strip of nails; said slot having an open lower end through which the nails can project; said side walls having a plurality of longitudinally extending opposed channels formed therein, with the channels on one side wall opening towards and opposing the corresponding channels on the other side wall to selectively receive therebetween the heads of the nails in a strip; said side walls having relatively flat surface portions above, below and between said channels and a nail discharge end and a nail guide plate mounted on said discharge end; said nail guide plate including a nail guide channel formed therein opening towards said slot between the side walls to receive a nail therein; and means for urging a strip of nails positioned in the slot between the side walls towards said discharge end whereby a nail is positioned in said nail guide channel; said means including a relatively flat plate received between said walls and biasing means located outside said side walls and connected to said plate below said side walls for biasing said plate against a nail strip in said slot towards said discharge end.

7. A nail magazine as defined in claim 6 including a front wall mounted on the discharge end of said side walls between said discharge end and the nail guide plate, said front wall having a nail discharge slot formed therein generally complementary to the lateral spacing of said side walls and said nail guide plate including a nail guide channel opening towards said plate to receive a nail exiting the slot and the nail driving element of the nailer.

8. A nail magazine as defined in claim 7 wherein said side walls have bottom longitudinal edges and said plate ends past said edges.

9. A nail magazine as defined in claim 8 wherein said plate includes means engaging one of said edges for guiding the plate in longitudinal movement and preventing upward movement of the plate relative to said edges.

10. A nail magazine as defined in claim 9, wherein said plate includes means for engaging said front wall, thereby to limit movement of said plate under the influence of said biasing means.

11. A nail magazine as defined in claim 9 including a front wall mounted adjacent the discharge end of said side walls; said front wall having a discharge slot formed therein generally complementary to the lateral spacing of the side walls.

* * * * *